United States Patent [19]

Maire

[11] 4,216,648

[45] Aug. 12, 1980

[54] SYSTEM FOR DETECTING THE END USEFUL LIFE OF A BATTERY IN AN ELECTRONIC TIME-PIECE

[75] Inventor: Bernard Maire, Marin, Switzerland

[73] Assignee: Ebauches SA, Neuchatel, Switzerland

[21] Appl. No.: 971,811

[22] Filed: Dec. 21, 1978

[30] Foreign Application Priority Data

Dec. 28, 1977 [CH] Switzerland ..... 16121/77

[51] Int. Cl.[2] ..... G04C 3/00; G08B 21/00

[52] U.S. Cl. ..... 368/66; 340/636

[58] Field of Search ..... 58/23 BA, 152 H; 340/636

[56] References Cited

U.S. PATENT DOCUMENTS

| | | | |
|---|---|---|---|
| 4,028,880 | 6/1977 | Ueda | 58/152 H |
| 4,163,193 | 7/1979 | Kamiya | 58/23 BA |

*Primary Examiner*—Edith S. Jackmon

*Attorney, Agent, or Firm*—Wender, Murase & White

[57] ABSTRACT

The invention concerns an electronic timepiece including a system for detecting the end of useful battery life. This system is based on a circuit for detecting the length of the driving pulses for the stepping motor, associated with a circuit for shortening the driving pulses. The detector circuit comprises two counters, the output logic levels of which coincide when the voltage of the battery has dropped to a value such that the stepping motor is at its limit of operation, in which case the duration of the driving pulses is at a maximum.

6 Claims, 15 Drawing Figures

SYSTEM FOR DETECTING THE END USEFUL LIFE OF A BATTERY IN AN ELECTRONIC TIME-PIECE

BACKGROUND OF THE INVENTION

The present invention concerns a system for detecting the end of useful life of a battery in an electronic timepiece having a stepping motor. Systems are already in existence in which the detection of the end of useful battery life is made by a measurement of the battery voltage and by a comparison thereof with a definite voltage level; when the battery voltage reaches this threshold, the watch indicates to the wearer that the batteries are at the end of their useful life.

However, such detection systems have the following disadvantages. On the one hand, if the defined voltage threshold for detecting the end of useful battery life is not close to the limit of the operation of the stepping motor, the watch may indicate to the wearer that the batteries are at the end of their useful life, whereas they could still be useful and insure good operation for several months. On the other hand, it is necessary to create the defined voltage threshold in the circuit which requires, according to present prior art, a resistor external to the integrated circuit, i.e., an extra component in the watch.

SUMMARY OF THE INVENTION

The object of the present invention is to provide a system for detecting the end of useful battery life which does not have the above mentioned disadvantages.

According to the present invention there is provided in an electronic time-piece a system for detecting the end of useful battery life, comprising an oscillator, a frequency divider chain, a system for shortening driving pulses, a watch logic, a logic control circuit, a stepping motor, and a system for detecting the length of the driving pulses associated with the said system for shortening said driving pulses, the output signal of the said detection system actuating, by means of the said watch logic, the signalling of the end of useful battery life.

The system according to the present invention is based on shortening the driving pulses of the stepping motor of analog quartz watches. This shortening is known in principle and it is described, for example, in the following documents.

Swiss specification No. 13723/72 describes a device for detecting the rotor speed of the stepping motor and means for interrupting the driving pulse in response to a signal issuing from the detection device, this signal corresponding to the maximum speed of rotation of the rotor. The invention disclosed in Swiss specification No. 17738/73 concerns a detector of the peak value usable in time-keeping and making it possible to determine, by measurement of the current in the driving coil, the moment when the rotor speed is maximum. Finally, Swiss Pat. No. 576164 describes a system detecting, among other things, the end of a rotation step of the motor and comprising means for terminating the driving pulse as soon as the detector indicates the end of a step.

The devices described in the above documents make it possible to interrupt the driving pulses as a function of the speed or position of the rotor. In every case the driving pulses are shortened.

The present invention will be described further, by way of example, with reference to the accompanying drawings.

DESCRIPTION OF THE PREFERRED EMBODIMENTS

Figure 1:
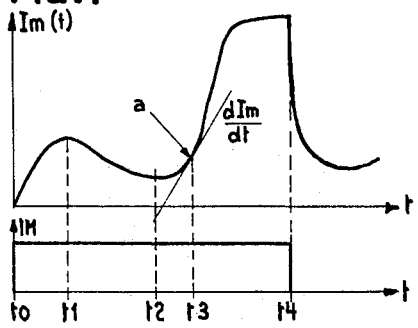
FIG. 1 is a diagrammatic representation of the motor current and the driving pulse in accordance with the present invention.

FIG. 1 shows the behaviour as a function of time of the current controlling a stepping motor. At the time t0, a driving pulse Im is sent to the driving coil of the motor. Between t0 and t1, the speed of the rotor is low and the motor current Im increases as a function of the time constant of the circuit, then, between t1 and t2, the rotor accelerates and the electromotive force (e.m.f.) induced in the coil reduces the current Im which reaches a minimum at t2, this instant corresponding to that in which the induced e.m.f. is a maximum. After t2, the rotor, which approaches its new resting position, slows down so that the current initially increases rapidly, then becomes constant until t4 when the rotor is stopped; the current drops to zero as soon as the driving pulse is interrupted.

It has been discovered in practice that at t2 the maximum speed of the rotor is sufficient to overcome the resistant torque and the result is that the driving pulse Im may be interrupted without the correct operation of the motor being affected thereby. In practice, the detection of the instant at which the driving pulse may be interrupted is made by a differentiator circuit which delivers an output voltage proportional to the slope of the current Im, i.e. the derivative dIm/dt of current Im. This output signal reaches a value sufficient to be utilized at t3, a short instant after t2. Consequently, the driving pulse will be interrupted at the instant t3, so that it is shortened relative to a pulse normally present as far as t4. It is obvious that the shortened pulse makes it possible to reduce the energy which would normally be delivered to the motor during the period t4−t3. In the following, and to simplify matters, we shall indicate by SRI the system for shortening pulses. Let us now examine how SRI acts on the driving current Im as a function of the feed voltage.

Figure 2:
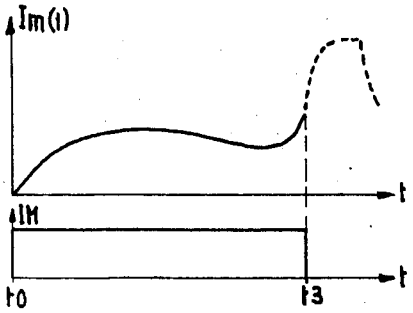
FIG. 2 is a diagrammatic representation of the current of a motor fed with nominal voltage in accordance with the present invention.

A case in which the motor is fed with nominal voltage is depicted in FIG. 2 which shows the typical behaviour of the driving current Im as a function of time. At the moment t3, SRI cuts out the driving pulse and it may be considered that the period t3−t0 of the shortened pulse is of nominal value.

Figure 3:
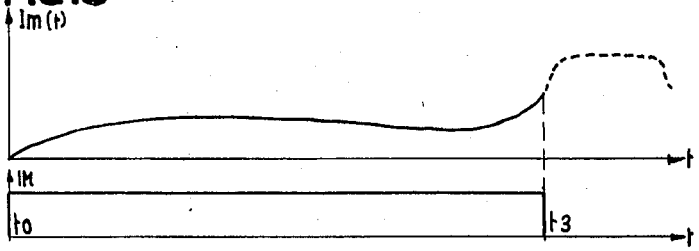
FIG. 3 is a diagrammatic representation of the current of a motor fed with low voltage in accordance with the present invention.

The case in which the motor is fed with low voltage is depicted in FIG. 3. As in the previous case, SRI cuts off the driving pulse at t3, i.e., when the slope of the current rises to give a usable voltage at the output of the differentiator. A comparison with FIG. 2 shows that the period t3−t0 of the driving pulse under low voltage is longer than in the case where the motor is fed with a nominal voltage.

Figure 4:
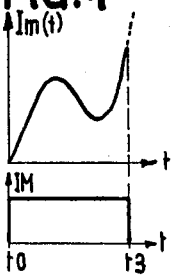
FIG. 4 is a diagrammatic representation of the driving current of a motor fed with high voltage in accordance with the present invention.

The case in which the motor is fed with high voltage is shown in FIG. 4. In this case, the driving pulse has a duration t3−t0 shorter than when the motor is fed with nominal voltage.

The above examples show that when the battery voltage decreases and the motor comes close to its limit of operation, SRI automatically lengthens the duration of the driving pulses.

Consequently, a suitable circuit for reacting when the driving pulses are systematically long, i.e. when the motor is close to the limit of its operation, makes it possible to detect that the batteries are at the end of their useful life and to give a signal indicating that it is necessary to change them.

Figure 5:
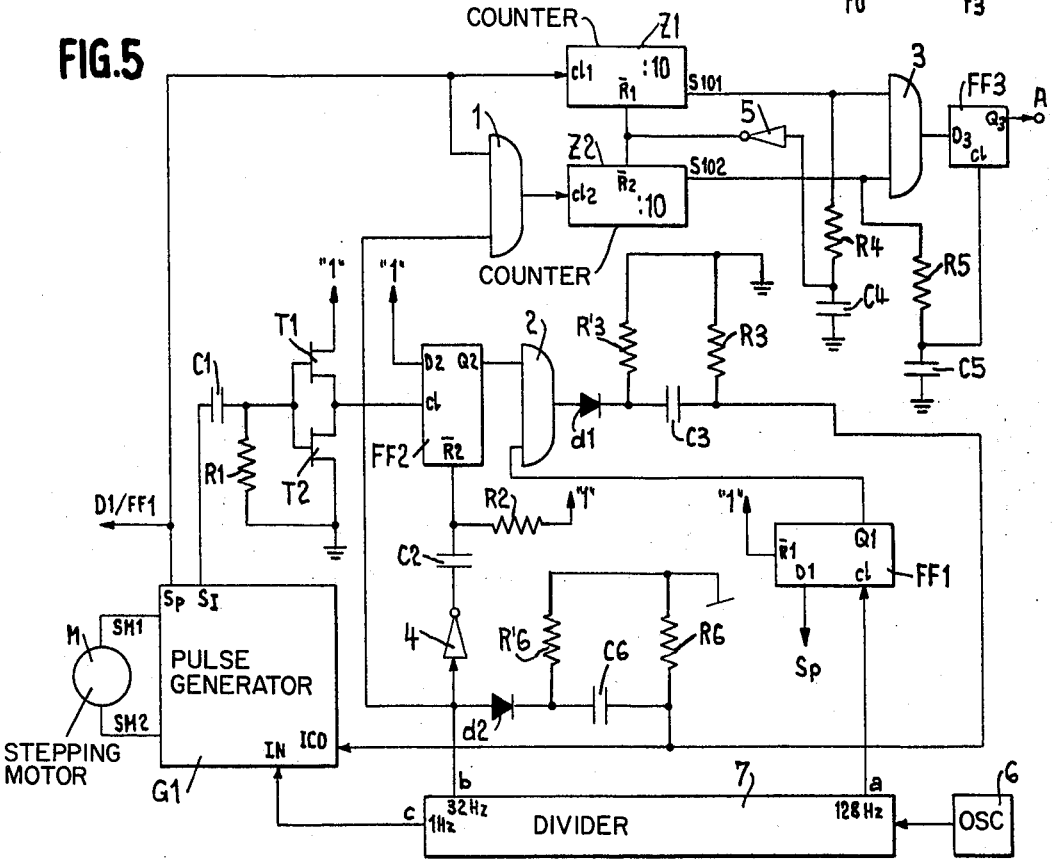
FIG. 5 is a diagrammatic representation of one embodiment of a system for detecting the end of useful battery life according to the invention.

FIG. 5 shows a diagram of a detection system according to the invention. The circuit comprises a quartz oscillator 6 feeding a divider chain 7 which delivers at a first output a a signal of 128 Hz to the clock input Cl of a D-type flip-flop FF1; at a second output b a signal of 32 Hz to the input of an inverter 4, to the anode of an insulating diode d2 and to a first input of an AND gate 1; and at a third output c a signal of 1 Hz to the input IN of a logic circuit and pulse generator circuit G1. The stepping motor M is fed by the outputs SM1 and SM2 of the circuit G1. An output Sp of circuit G1 is connected to the input D1 of flip-flop FF1, whose reset input is at the level L, to the second input of the AND gate 1, and to the clock input Cl1 of a first decade counter Z1. The output of AND gate 1 is connected to the clock input Cl2 of a second decade counter Z2. An input SI of the circuit G1 is connected to the input of an RC differentiator C1R1, the output of which is connected to the input of an inverter T1, T2. The output of the inverter T1,T2 is connected to the clock input Cl of a D flip-flop FF2, the input D2 of which is at the logic level L. The output of inverter 4 is connected to the input of an RC differentiator C2R2, the output of which is connected to the reset input $\overline{R2}$ of the flip-flop FF2.

The output Q2 of flip-flop FF2 is connected to a first input of an AND gate 2. The second input of the AND gate 2 is connected to the output Q1 of flip-flop FF1. The output of the gate 2 is connected to the anode of an insulating diode d1, the cathode of which is connected to a resistor R3', connected to earth and to the input of an RC differentiator C3R3, the output of which is connected to an input Ico of the circuit G1 and to the output of an RC differentiator C6R6, the input of which is connected to a resistor R6' and to the cathode of the diode d2.

The output of the counter Z1 is connected to the first input of an AND gate 3 and to the input of an integrator circuit R4C4, the output of which is connected, via an inverter 5, to the reset inputs $\overline{R1}$ and $\overline{R2}$ of the counters Z1 and Z2. The output of the counter Z2 is connected to the second input of the AND gate 3 and to the input of an integrator circuit R5C5, the output of which is connected to the clock input Cl of a D flip-flop FF3. The output of the AND gate 3 is connected to the input D3 of flip-flop FF3 and the output Q3 of this flip-flop FF3 is connected to an input A of a watch logic (not shown).

The circuit shown in FIG. 5 consists basically of two parts: The system for shortening pulses (SRI) and the system for detecting driving pulses. The operation of system SRI will be described first.

The unipolar image of driving pulses is found at the output Sp of circuit G1, whilst the unipolar image, in voltage, of the motor current Im is found at the output SI. The input Ico of circuit G1 cuts out the driving pulse when it receives a positive pulse.

The SRI system of the circuit shown in the embodiment of FIG. 5 exhibits certain characteristics:

The value of the derivative for which the SRI should react is fixed by the values of C1 and R1.

Figure 6:
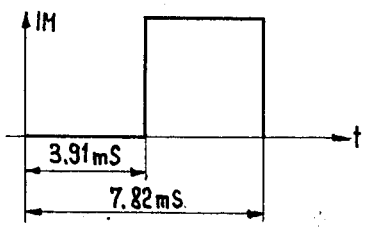
FIG. 6 is a diagrammatic representation of the driving pulse having a minimum duration.
Figure 7:
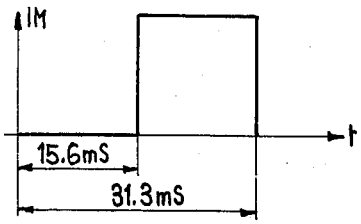
FIG. 7 is a diagrammatic representation of the driving pulse of maximum duration.

The minimum duration of the driving pulse Im is equal to the half period of the 128 Hz signal, i.e. $t_{min} = \frac{1}{2} \cdot 128 = 3.91$ mS (FIG. 6). The maximum duration of the driving pulse Im is equal to the half period of the 32 Hz signal, i.e. $t_{max} = \frac{1}{2} \cdot 32 = 15.6$ mS (FIG. 7).

Figure 8:
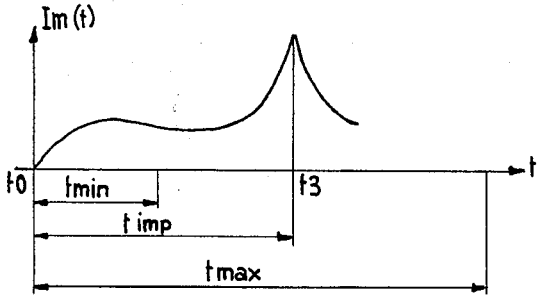
FIG. 8 is a diagrammatic representation of the current Im when the duration of the driving pulse is between tmin and tmax.
Figure 9:
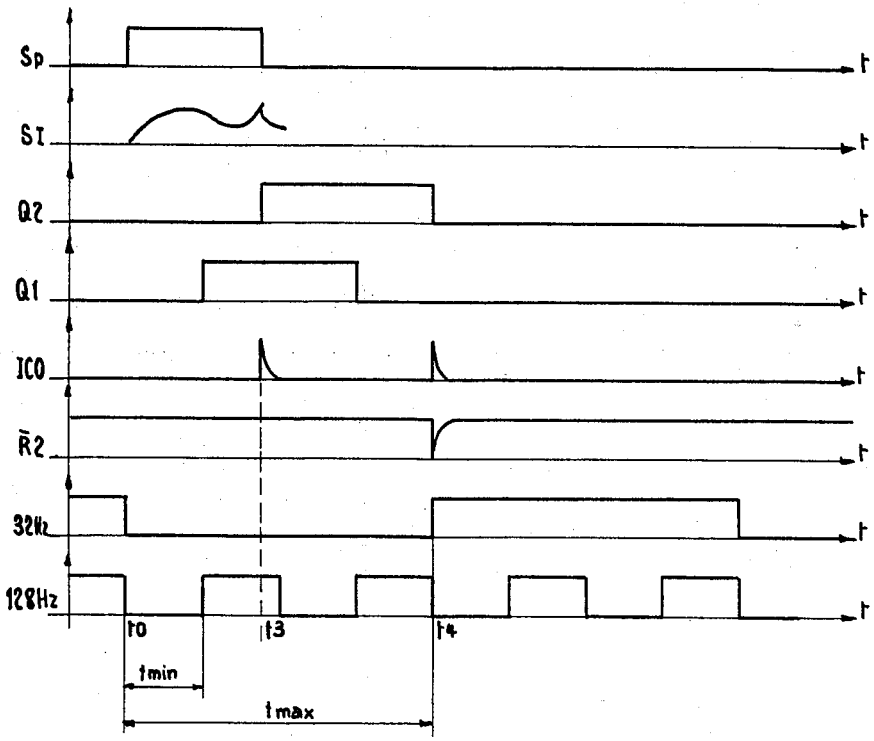
FIG. 9 is a pulse diagram corresponding to the case shown in FIG. 8.

Let us now examine the case where the duration (t3−t0) is between tmin and tmax. FIG. 8 shows the driving current Im and FIG. 9 the signals at different points of the diagram in FIG. 5. The driving pulse is applied to the terminals of the motor at the instant t0 and, after a time tmin=3.91 mS, the 128 Hz output has given a clock pulse thereof to the flip-flop FF1, the Q1 output of which passes to the logic level L, thus opening the gate 2. When the differentiator C1R1 delivers, at the moment t3, a signal to the input of the inverter T1, T2, and the output thereof switches flip-flop FF2, the Q2 output of which passes to the logic level L, so that a logic level L appears at the output of the AND gate 2. At the moment of the transition from 0 to L of the output of AND gate 2, the differentiator C3R3 feeds a positive pulse to the input Ico of circuit G1, thus terminating the driving pulse. The duration thereof is therefore (t3−t0), between tmin and tmax. The flip-flop FF2 is returned to zero by the arrival at t4 of the leading edge of the next 32 Hz pulse from b, through the inverter 4 and the differentiator C2R2, a half period of 32 Hz after the start at t0 of the driving pulse. The flip-flop FF1 is returned to zero by the 128 Hz pulse from a, which follows the instant t3.

Figure 10:
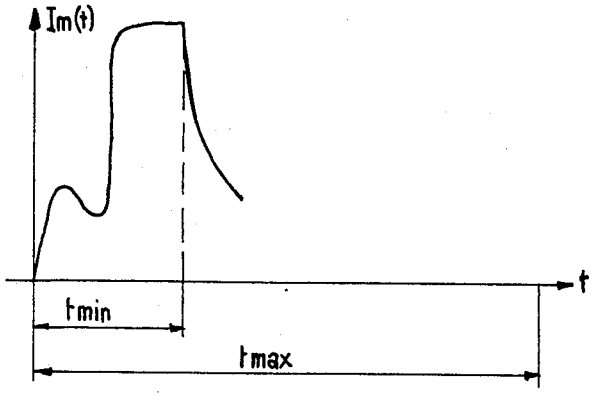
FIG. 10 is a diagrammatic representation of the current Im when the speed of the motor is such that the duration t3−t0, as measured by the differentiator circuit, is shorter than tmin.
Figure 11:
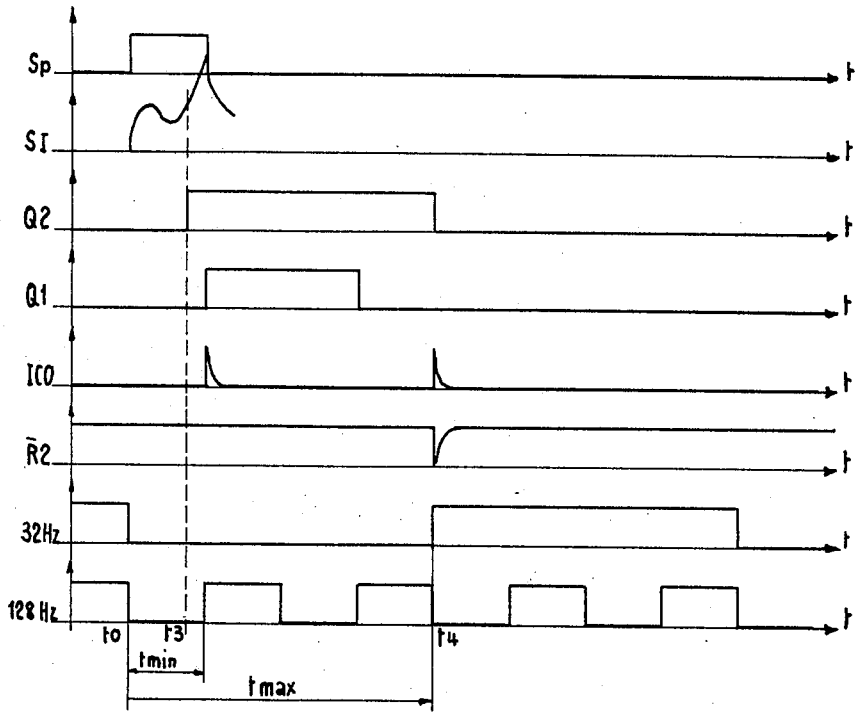
FIG. 11 is a pulse diagram corresponding to the case shown in FIG. 10.

Let us now examine the case in which the duration (t3−t0) is shorter than tmin. FIG. 10 shows the driving current Im, and FIG. 11 shows the signals at different points of the diagram in FIG. 5. The driving pulse is applied to the motor at the instant t0. Until the flip-flop FF1, controlled by the 128 Hz signal at output a, switches, the gate 2 is closed. Consequently, if the motor turns rapidly, the differentiator C1R1 will control flip-flop FF2 which will set a logic level L at the input of the gate 2 while it is still locked by flip-flop FF1. A time tmin after t0, the 128 Hz signal switches flip-flop FF1, and the output of the gate 2 passes from the level 0 to the level L. This transition produces, via the differentiator C3R3, a positive pulse at the input Ico of circuit G1, interrupting the driving pulse. The duration thereof is therefore equal to tmin. The flip-flops FF2 and FF3 are returned to zero as in the preceding case.

Figure 12:
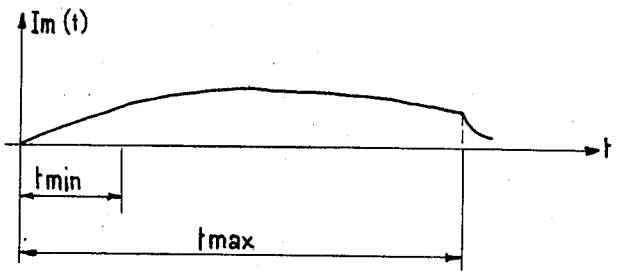
FIG. 12 is a diagrammatic representation of the current Im when the speed of the motor is such that the duration t3−t0, as measured by the differentiator circuit, is longer than tmax.
Figure 13:
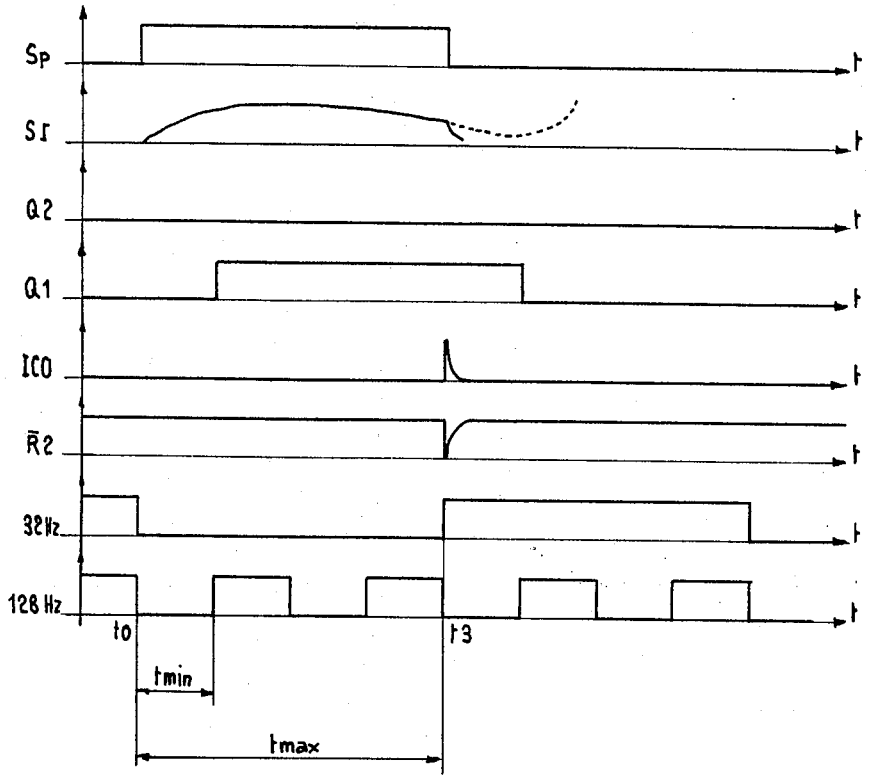
FIG. 13 is a pulse diagram corresponding to the case shown in FIG. 12.

Finally, let us examine the case in which the duration (t3−t0) is greater than tmax. FIG. 12 shows the driving current Im, and FIG. 13 shows the signals at different points of the diagram of FIG. 5. As before, the driving pulse is applied at time t0 to the motor. If the motor has not turned, the circuit C1R1-FF2 has not functioned and the output Q2 of flip-flop FF2 is at level 0. The driving pulse will then remain applied to the motor until the instant t3 when the leading edge of the 32 Hz signal at output b gives, via the differentiator C6R6, a positive pulse to the input Ico of circuit G1, thus interrupting the driving pulse, which has duration (t3−t0) equal to tmax.

The preceding description of the operation of the SRI system shows that the duration of the driving pulse is always between tmin and tmax. It has already been seen that the pulse may achieve the duration tmax when the battery voltage is low. This duration may therefore be used as a criterion for initiating an indication of the end of the useful life of the batteries.

Figure 14:
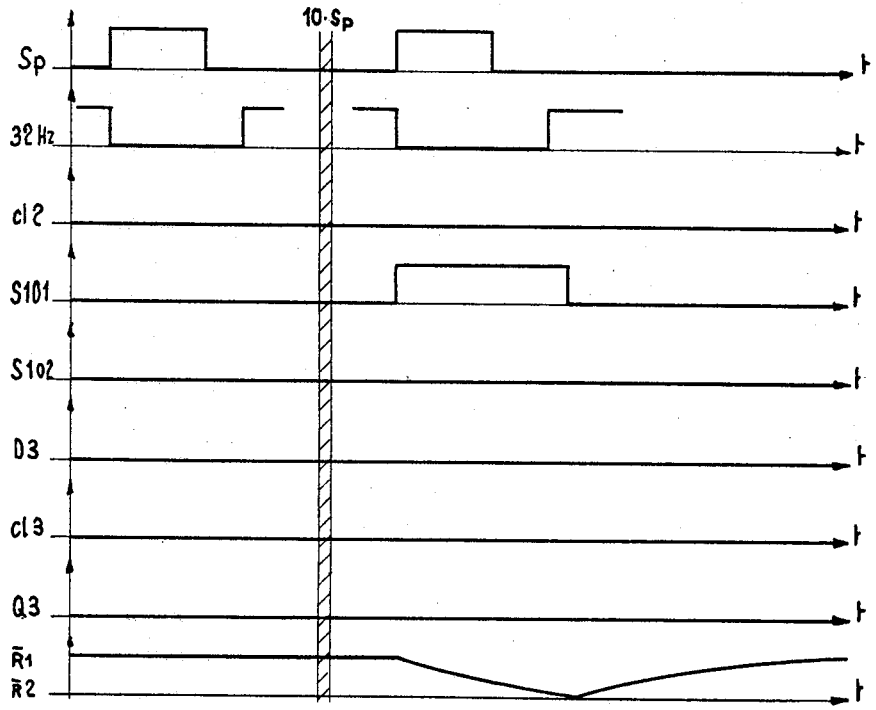
FIG. 14 is a pulse diagram corresponding to the case in which the speed of the motor is such that (t3−t0) is shorter than tmax.

The operation of the system for detecting the length of pulses will now be explained. This detection system is schematically shown in FIG. 5. Let us first examine the behavior of the circuit when the duration (t3−t0) of the driving pulse is between tmin and tmax. FIG. 14 is the corresponding pulse diagram. The signal at the output Sp of the circuit G1 is used as clock pulse for the decade counter Z1. The result is that the counter Z1 is actuated with each driving pulse. When it receives the tenth pulse its output S101 passes from logic level 0 to logic level L. This output signal is integrated by the circuit R4C4, the output of which resets the counters Z1 and Z2 to zero via an inverter 5. FIG. 14 shows that the inputs (signals Sp and 32 Hz signal at output b) of the gate 1 are never simultaneously at the level L. The gate 1 therefore remains closed, so that the counter Z2 does not increment and its output S102 remains at the level 0. The AND gate 3 remains closed, the flip-flop FF3 does not function and its output Q3 is therefore always at the level 0. Hence, when the motor is operating normally, the watch logic does not receive any signal at A coming from the circuit shown in FIG. 5.

Figure 15:
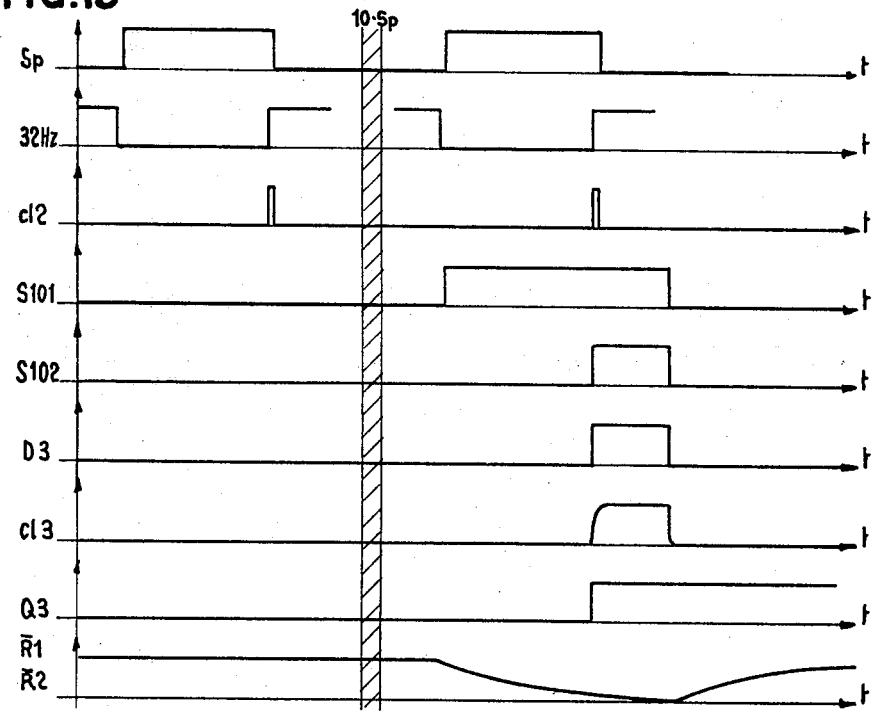
FIG. 15 is a pulse diagram corresponding to the case in which the speed of the motor is such that (t3−t0) is longer than tmax.

The operation of the detection system, when the duration (t3−t0) is greater than tmax, is as follows. As discussed previously, the counter Z1 is actuated with each driving pulse. FIG. 15 shows that both inputs of the gate 1 are simultaneously at the level L for a brief moment, thus causing Z2 to count. It the outputs S101 and S102 of the counters Z1 and Z2 pass simultaneously to the level L during the 10th input pulse, the output of the gate 3 passes from 0 to L, thus switching flip-flop FF3 causing the output Q3 thereof to pass from level 0 to level L. This is interpreted by the display logic as an instruction to start signalling the end of the useful life of the battery.

The addition of a system for detecting the length of pulses to an SRI system therefore makes it possible to provide a system for detecting the end of useful battery life which is particularly efficient in that it takes into consideration the actual discharge state of the battery, and its influence on the driving pulses of the stepping motor. The system is relatively simple and it lends itself very well to inclusion, by integrated circuit techniques, in the integrated circuit of the time-piece.

The circuit forming the object of FIG. 5 is a possible embodiment of the invention. However, it is obvious that other embodiments, in which a circuit for detecting the length of the driving pulses is associated with an SRI, also come within the scope of the present invention.

I claim:

1. A system for detecting the end of useful life of a battery in an electronic time-piece in which driving pulses are applied to a stepping motor having a coil, said driving pulses having a duration depending on the intensity of the current in the motor coil such that the pulse duration increases as the voltage supplied by the battery to the coil decreases, said system comprising:
   - means for producing image pulses with the same duration as that of said driving pulses; and
   - detecting means responsive to said image pulses having a duration higher than a predetermined value for producing a signal indicating the end of useful life of the battery.

2. The system of claim 1, wherein said detecting means includes means for delivering said indicating signal in response to a predetermined number of consecutive image pulses each having a duration longer than said predetermined value.

3. The system of claim 2, wherein said delivering means comprises:
   - first counter means for delivering a first logic output signal in response to a number of image pulses equal to said predetermined number;
   - second counter means for delivering a second logic output signal in response to said predetermined number of consecutive image pulses each having a duration longer than said predetermined value; and
   - means coupled to said first and second counter means for delivering said signal indicating the end of useful battery life in the event of coincidence of said first and second logic output signals.

4. The system of claim 3, where said detection means includes means coupled to said first and second counter means being responsive to said first logic output signal for resetting said first and second counter means to zero.

5. The system of claim 4, wherein said detection means includes means coupled to said delivering means for storing said indicating signal.

6. A system for detecting the end of useful life of a battery used to power a stepping motor having a coil in an electronic timepiece, comprising:
   - an oscillator for producing a high frequency signal;
   - a frequency divider coupled to said oscillator for delivering a plurality of output signals in response to said oscillator signal;
   - means coupled to said frequency divider and stepping motor for producing driving pulses for driving the stepping motor, said driving pulses having a duration determined by the intensity of the driving current in the stepping motor coil such that the pulse duration increases as the voltage supplied by the battery to the motor coil decreases, said driving pulse producing means further producing an image pulse having the same duration as that of said driving pulse; and detecting means coupled to said driving pulse producing means responsive to said image pulse for detecting when the duration of said image pulse is longer than a predetermined value corresponding to a predetermined discharge state of the battery, said detecting means further producing a signal indicating the end of useful life of the battery.

* * * * *